US010873160B2

(12) United States Patent
Henry et al.

(10) Patent No.: US 10,873,160 B2
(45) Date of Patent: Dec. 22, 2020

(54) RECEPTACLE ASSEMBLY HAVING CABLED RECEPTACLE CONNECTOR

(71) Applicant: TE CONNECTIVITY CORPORATION, Berwyn, PA (US)

(72) Inventors: Randall Robert Henry, Lebanon, PA (US); Michael John Phillips, Camp Hill, PA (US); Brandon Michael Matthews, McAlisterville, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 16/404,146

(22) Filed: May 6, 2019

(65) Prior Publication Data

US 2020/0358227 A1 Nov. 12, 2020

(51) Int. Cl.

| | |
|---|---|
| ***H01R 13/6585*** | (2011.01) |
| ***H01R 13/6592*** | (2011.01) |
| ***H01R 12/72*** | (2011.01) |
| ***H01R 13/6597*** | (2011.01) |
| ***H01R 13/502*** | (2006.01) |

(52) U.S. Cl.

CPC ..... *H01R 13/6585* (2013.01); *H01R 12/72* (2013.01); *H01R 13/502* (2013.01); *H01R 13/6592* (2013.01); *H01R 13/6597* (2013.01)

(58) Field of Classification Search

CPC ..... H01R 13/6585; H01R 13/502; H01R 13/6592; H01R 13/6597; H01R 12/72; H01R 12/596; H01R 12/775

USPC ..... 439/607.08

See application file for complete search history.

(56) References Cited

U.S. PATENT DOCUMENTS

| | | | | |
|---|---|---|---|---|
| 5,997,361 | A * | 12/1999 | Driscoll | H01R 13/6599 439/358 |
| 6,771,511 | B2 | 8/2004 | Bui | |
| 6,926,553 | B2 * | 8/2005 | Wu | H01R 9/0515 439/497 |
| 7,311,753 | B2 | 12/2007 | Bruske | |
| 8,475,208 | B2 | 7/2013 | Simpson et al. | |
| 9,142,921 | B2 * | 9/2015 | Wanha | H01R 13/6477 |
| 9,354,405 | B2 | 5/2016 | Yeh | |
| 9,389,368 | B1 | 7/2016 | Sharf | |
| 9,437,949 | B2 | 9/2016 | Behziz et al. | |

(Continued)

FOREIGN PATENT DOCUMENTS

WO 2016/179263 A1 11/2016

*Primary Examiner* — Hien D Vu

(57) ABSTRACT

A cabled receptacle connector includes a receptacle housing having a cavity extending between a front and a rear and having a mating slot receiving a pluggable module. A cable assembly is received in the cavity having wafers provided at an end of a cable bundle. Each wafer has a dielectric frame holding a wafer lead frame having signal contacts and ground contacts. The signal and ground contacts have terminating ends terminated to corresponding cables and mating ends received in the mating slot for mating with the pluggable module. Each wafer has a ground bus frame electrically coupled to each of the ground contacts to electrically common each of the ground contacts. The ground bus includes ground beams having mounting arms coupled to the dielectric frame and mating pads coupled to corresponding ground contacts. The mating ends of the signal contacts and the ground contacts are arranged in multiple rows for interfacing with the pluggable module.

23 Claims, 7 Drawing Sheets

(56) References Cited

U.S. PATENT DOCUMENTS

| | | | | |
|---|---|---|---|---|
| 9,484,678 | B1 | 11/2016 | Briant et al. | |
| 9,793,633 | B2 * | 10/2017 | Liao | H01R 12/721 |
| 9,825,387 | B2 | 11/2017 | Cheng et al. | |
| 9,985,367 | B2 | 5/2018 | Wanha et al. | |
| 10,103,453 | B2 * | 10/2018 | Pao | H01R 4/023 |
| 10,396,513 | B2 * | 8/2019 | Regnier | H01R 12/75 |
| 2014/0041937 | A1 * | 2/2014 | Lloyd | H05K 1/0243 174/74 R |
| 2016/0197423 | A1 * | 7/2016 | Regnier | H01R 9/0515 439/59 |
| 2017/0077643 | A1 | 3/2017 | Zbinden et al. | |
| 2017/0288330 | A1 | 10/2017 | Cheng et al. | |
| 2017/0294721 | A1 | 10/2017 | Pao et al. | |
| 2018/0166807 | A1 | 6/2018 | Boyd et al. | |

* cited by examiner

RECEPTACLE ASSEMBLY HAVING CABLED RECEPTACLE CONNECTOR

BACKGROUND OF THE INVENTION

The subject matter herein relates generally to communication systems and receptacle assemblies for communication systems.

Communication systems are known to have receptacle assemblies mounted to host circuit boards. The communication systems typically include a board mounted receptacle connector mounted directly to the host circuit board within a receptacle cage. The receptacle connector has contacts including mating ends defining a mating interface for mating with pluggable modules and terminating ends that are terminated directly to the host circuit board. Signal paths are defined from the pluggable modules to the host circuit board through the signal contacts of the receptacle connectors. However, known receptacle assemblies are not without disadvantages. For example, the electrical signal paths through the host circuit board routed to another electrical component may be relatively long leading to problems with signal loss along the electrical signal paths.

Some known communication systems utilize receptacle connectors having cables terminated to the signal contacts rather than terminating the signal contacts directly to a host circuit board. However, incorporating such cabled receptacle connectors into a receptacle cage is problematic. Removal and/or replacement of such cabled receptacle connectors is problematic. Electrical shielding of the signal paths through such cabled receptacle connectors may be difficult.

A need remains for a cost effective and reliable receptacle assembly for a communication system.

BRIEF DESCRIPTION OF THE INVENTION

In one embodiment, a cabled receptacle connector is provided for a receptacle assembly including a receptacle housing having a cavity extending between a front and a rear of the receptacle housing. The receptacle housing has a mating slot at the front configured to receive a pluggable module removably received in a receptacle cage of the receptacle assembly. A cable assembly is received in the cavity. The cable assembly includes wafers provided at an end of a cable bundle. Each wafer has a dielectric frame holding a wafer lead frame. The wafer lead frame has signal contacts and ground contacts interspersed with the signal contacts. The signal contacts have terminating ends terminated to corresponding cables of the cable bundle. The ground contacts have terminating ends terminated to corresponding cables of the cable bundle. The signal contacts have mating ends received in the mating slot for mating with the pluggable module. The ground contacts have mating ends received in the mating slot for mating with the pluggable module. Each wafer has a ground bus frame electrically coupled to each of the ground contacts to electrically common each of the ground contacts. The ground bus includes ground beams having mounting arms coupled to the dielectric frame and mating pads coupled to corresponding ground contacts. The mating ends of the signal contacts and the ground contacts are arranged in multiple rows for interfacing with the pluggable module.

In another embodiment, a cabled receptacle connector is provided for a receptacle assembly including a receptacle housing having a cavity extending between a front and a rear of the receptacle housing. The receptacle housing has a mating slot at the front configured to receive a pluggable module removably received in a receptacle cage of the receptacle assembly. A cable assembly is received in the cavity including a wafer stack provided at an end of a cable bundle. The wafer stack has a plurality of wafers arranged in a stacked configuration. The plurality of wafers includes an upper outboard wafer and an upper inboard wafer arranged in an upper wafer assembly. The plurality of wafers includes a lower outboard wafer and a lower inboard wafer arranged in a lower wafer assembly. The lower and upper inboard wafers are stacked between the lower and upper outboard wafers. Each wafer has a dielectric frame holding a wafer lead frame. The wafer lead frame has signal contacts and ground contacts interspersed with the signal contacts. The signal contacts have terminating ends terminated to corresponding cables of the cable bundle. The ground contacts have terminating ends terminated to corresponding cables of the cable bundle. The signal contacts have mating ends received in the mating slot for mating with the pluggable module. The ground contacts have mating ends received in the mating slot for mating with the pluggable module. The cable assembly has a ground bus frame electrically coupled to each of the ground contacts to electrically common each of the ground contacts.

In a further embodiment, a receptacle assembly is provided including a receptacle cage and a cable receptacle connector received in the receptacle cage. The receptacle cage includes a plurality of walls defining a module channel extending between a front and a rear of the receptacle cage. The plurality of walls includes a top wall, a first side wall extending from the top wall to a bottom of the receptacle cage and a second side wall extending from the top wall to the bottom. The module channel is open at the front to receive a pluggable module therein. The module channel is open at the rear. The cabled receptacle connector is received in the module channel at the rear of the receptacle cage. The cabled receptacle connector includes a receptacle housing having a cavity extending between a front and a rear of the receptacle housing. The receptacle housing has a mating slot at the front configured to receive a pluggable module removably received in a receptacle cage of the receptacle assembly. A cable assembly is received in the cavity. The cable assembly includes a wafer provided at an end of a cable bundle. The wafer has a dielectric frame holding a wafer lead frame. The wafer lead frame has signal contacts and ground contacts interspersed with the signal contacts. The signal contacts have terminating ends terminated to corresponding cables of the cable bundle. The ground contacts have terminating ends terminated to corresponding cables of the cable bundle. The signal contacts have mating ends received in the mating slot for mating with the pluggable module. The ground contacts have mating ends received in the mating slot for mating with the pluggable module. The cable assembly has a ground bus frame electrically coupled to each of the ground contacts to electrically common each of the ground contacts. The first wafer extends forward of the second wafer and the mating ends of the first wafer are in a first row positioned forward of a second row of the mating ends of the second wafer.

DETAILED DESCRIPTION OF THE INVENTION

Various embodiments described herein include a receptacle cage for a receptacle assembly of a communication system, such as for an input/output (I/O) module. The receptacle cage may be configured for a quad small form-factor pluggable (QSFP), a small form-factor pluggable (SFP), an octal small form-factor pluggable (OSFP), and the like. In various embodiments, the receptacle cage includes an opening positioned at a rear of the receptacle cage to allow for a direct-attached, cabled receptacle connector to be loaded therein at the rear and an opening positioned at a front of the receptacle cage to receive a pluggable module for mating with the corresponding cabled receptacle connector. The cabled receptacle connector is mounted directly to the receptacle cage. The cabled receptacle connectors in the receptacle cage are configured to be coupled directly to another component via the cable rather than being terminated to a host circuit board, as is common with conventional receptacle assemblies, which improves signal loss and improves skew by transmitting the signals via cables versus standard, board mounted receptacle connectors. In various embodiments, the receptacle assembly may be utilized without a host circuit board altogether, such as by mounting the receptacle cage to another component other than a circuit board.

Figure 1:
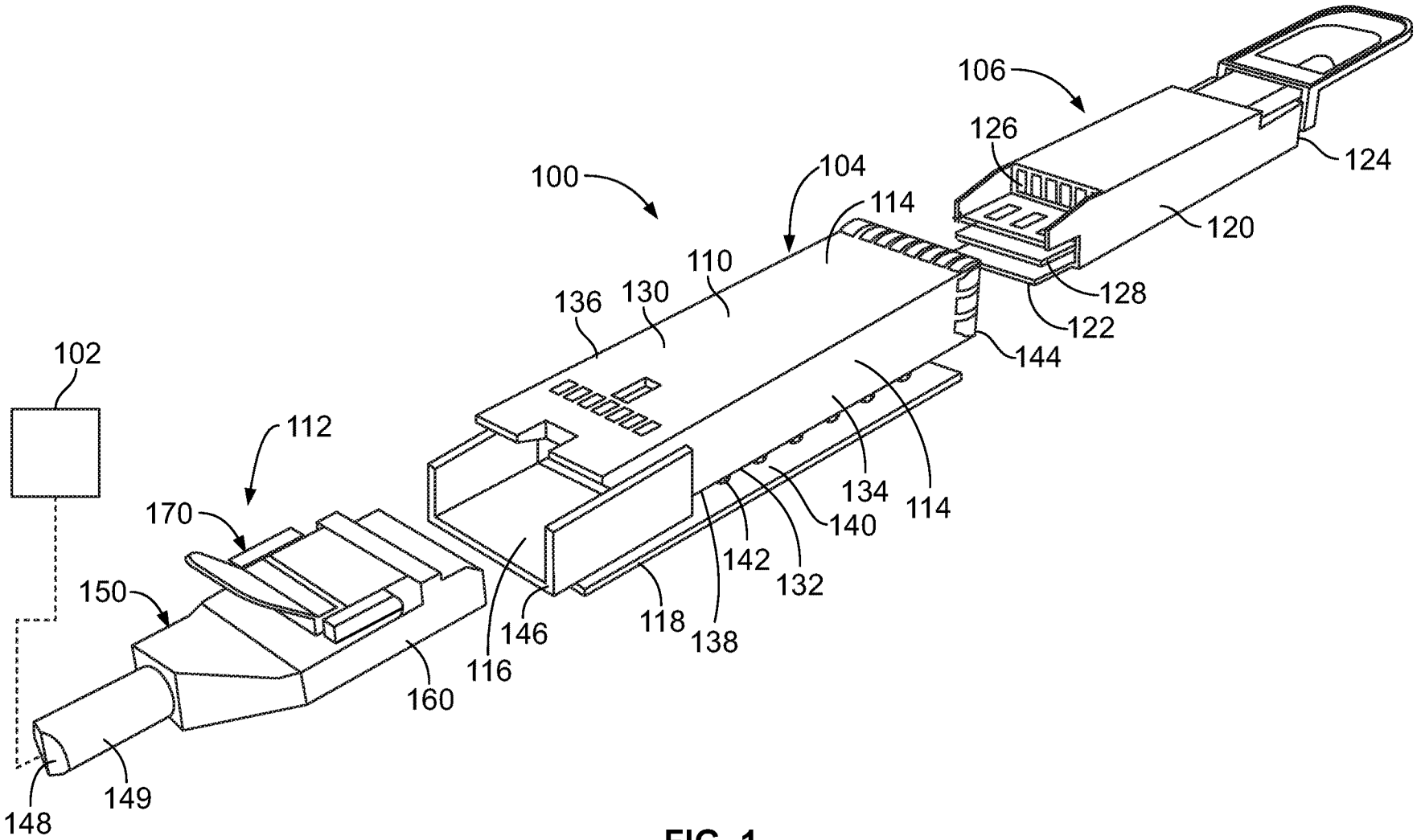
FIG. 1 is an exploded view of a communication system formed in accordance with an exemplary embodiment.
Figure 2:
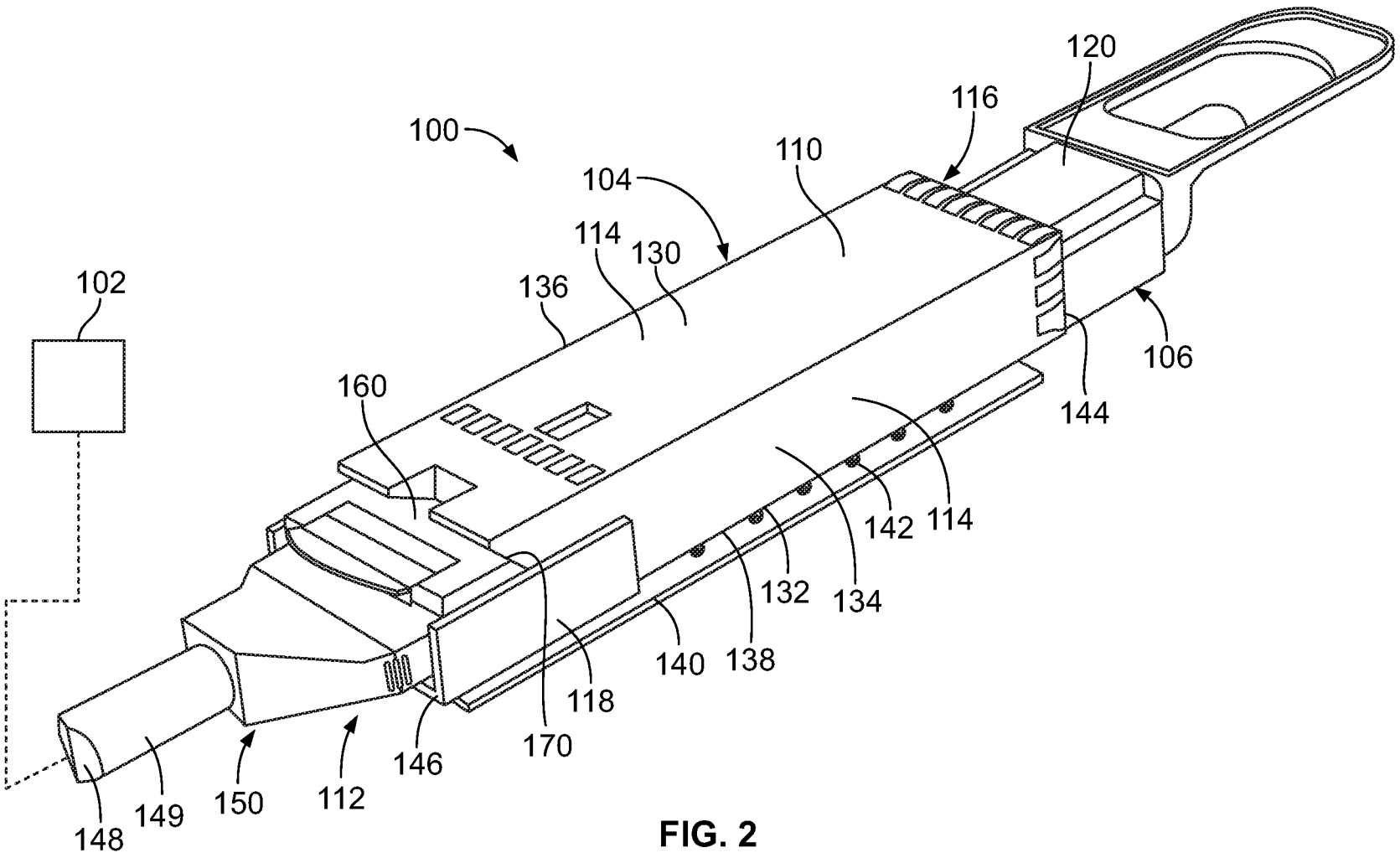
FIG. 2 is a rear perspective view of the communication system in an assembled state.

FIG. 1 is an exploded view of a communication system 100 formed in accordance with an exemplary embodiment. FIG. 2 is a rear perspective view of the communication system 100 in an assembled state. The communication system 100 includes an electrical component 102 and a receptacle assembly 104 electrically connected to the electrical component 102. The electrical component 102 may be located remote from the receptacle assembly 104, such as behind the receptacle assembly 104. The receptacle assembly 104 is electrically connected to the electrical component 102 via cables. A pluggable module 106 is configured to be electrically connected to the receptacle assembly 104. The pluggable module 106 is electrically connected to the electrical component 102 through the receptacle assembly 104. For example, the signals of the receptacle assembly 104 may be electrically connected to the electrical component 102 via cables rather than conductive traces of a circuit board. In various embodiments, the receptacle assembly 104 may be mated with a plurality of pluggable modules 106 rather than a single pluggable module 106.

In an exemplary embodiment, the receptacle assembly 104 includes a receptacle cage 110 and a cabled receptacle connector 112 received in the receptacle cage 110 for mating with the corresponding pluggable module 106. Optionally, a portion of the cabled receptacle connector 112 may extend from or be located rearward of the receptacle cage 110. In various embodiments, the receptacle assembly 104 may include a plurality of cabled receptacle connectors 112 within the receptacle cage 110 rather than a single cabled receptacle connector 112.

In various embodiments, the receptacle cage 110 is enclosed and provides electrical shielding for the cabled receptacle connector 112. The pluggable module 106 is loaded into the front of the receptacle cage 110 and is at least partially surrounded by the receptacle cage 110. In an exemplary embodiment, the receptacle cage 110 includes a shielding, stamped and formed cage member that includes a plurality of shielding walls 114 that define a module channel 116 that receives the pluggable module 106 and the cabled receptacle connector 112. In an exemplary embodiment, the receptacle cage 110 includes a guide 118 at the rear for positioning the cabled receptacle connector 112 in the receptacle cage 110. In various embodiments, the guide 118 is separate and discrete from the shielding walls 114 defining the cage member and coupled thereto, such as at a rear of the receptacle cage 110. In other various embodiments, the guide 118 may be integral with the cage member, such as being defined by the shielding walls 114.

In other embodiments, the receptacle cage 110 may be open between frame members to provide cooling airflow for the pluggable module 106 and the cabled receptacle connector 112 with the frame members of the receptacle cage 110 defining guide tracks for guiding loading of the pluggable modules 106 into the receptacle cage 110. In other various embodiments, the receptacle cage 110 may constitute a stacked cage member and/or a ganged cage member having a plurality of module channels 116 stacked and/or ganged vertically or horizontally.

As shown in FIG. 1, the pluggable module 106 has a pluggable body 120, which may be defined by one or more shells. The pluggable body 120 may be thermally conductive and/or may be electrically conductive, such as to provide EMI shielding for the pluggable module 106. The pluggable body 120 includes a mating end 122 and an opposite front end 124. The mating end 122 is configured to be inserted into the module channel 116. The front end 124 may be a cable end having a cable extending therefrom to another component within the system.

The pluggable module 106 includes a module circuit board 128 that is configured to be communicatively coupled to the cabled receptacle connector 112. The module circuit board 128 may be accessible at the mating end 122. The module circuit board 128 may include components, circuits and the like used for operating and or using the pluggable module 106. For example, the module circuit board 128 may have conductors, traces, pads, electronics, sensors, controllers, switches, inputs, outputs, and the like associated with the module circuit board 128, which may be mounted to the module circuit board 128, to form various circuits.

The pluggable module 106 includes an outer perimeter defining an exterior of the pluggable body 120. The exterior extends between the mating end 122 and the front end 124 of the pluggable module 106. In an exemplary embodiment, the pluggable body 120 provides heat transfer for the module circuit board 128, such as for the electronic components on the module circuit board 128. For example, the module circuit board 128 is in thermal communication with the pluggable body 120 and the pluggable body 120 transfers heat from the module circuit board 128. In an exemplary embodiment, the pluggable body 120 includes a plurality of heat transfer fins 126 along at least a portion of the outer perimeter of the pluggable module 106. The fins 126 transfer heat away from the main shell of the pluggable body 120, and thus from the module circuit board 128 and associated components. The fins 126 are separated by gaps that allow airflow or other cooling flow along the surfaces of the fins 126 to dissipate the heat therefrom. In the illustrated embodiment, the fins 126 are parallel plates that extend lengthwise; however, the fins 126 may have other shapes in alternative embodiments, such as cylindrical or other shaped posts. The pluggable module 106 may have a top wall over the fins 126.

In an exemplary embodiment, the walls 114 of the receptacle cage 110 include a top wall 130, a bottom wall 132, a first side wall 134 and a second side wall 136. The first and second side walls 134, 136 extend from the top wall 130 to a bottom 138 of the receptacle cage 110, such as to the bottom wall 132. However, in other various embodiments, the receptacle cage 110 is provided without the bottom wall 132 and the side walls 134, 136 may be mounted to a component 140, such as a chassis, substrate or circuit board. In various embodiments, the bottom wall 132 may rest on the component 140, such as a chassis, substrate or circuit board. Optionally, the walls 114 may include mounting features 142, such as compliant pins, used to mount the receptacle cage 110 to the component 140.

In an exemplary embodiment, the receptacle cage 110 may include one or more gaskets at a front 144 of the receptacle cage 110. For example, the gaskets may be configured to electrically connect with the pluggable module 106 and/or a bezel or other panel at the front 144. For example, the receptacle cage 110 may be received in a bezel opening of a bezel and the gasket may electrically connect to the bezel within the bezel opening.

In an exemplary embodiment, the receptacle assembly 104 may include one or more heat sinks (not shown) for dissipating heat from the pluggable module 106. For example, the heat sink may be coupled to the top wall 130 for engaging the pluggable module 106. The heat sink may extend through an opening in the top wall 130 to directly engage the pluggable module 106. Other types of heat sinks may be provided in alternative embodiments.

In an exemplary embodiment, the cabled receptacle connector 112 is received in the receptacle cage 110, such as at a rear 146 of the receptacle cage 110. The rear 146 is open to receive the cabled receptacle connector 112. The cabled receptacle connector 112 is positioned in the module channel 116 to interface with the pluggable module 106 when loaded therein. In an exemplary embodiment, the cabled receptacle connector 112 is received in the receptacle cage 110. The pluggable module 106 is loaded through the front 144 to mate with the cabled receptacle connector 112. The shielding walls 114 of the receptacle cage 110 provide electrical shielding around the cabled receptacle connector 112 and the pluggable modules 106, such as around the mating interfaces between the cabled receptacle connector 112 and the pluggable modules 106. The cabled receptacle connector 112 is electrically connected to the electrical component 102 via cables 148 of a cable bundle 149 extending rearward from the cabled receptacle connector 112. The cables 148 are routed to the electrical component 102, such as behind the receptacle cage 110.

The cabled receptacle connector 112 includes a cable assembly 150 including contacts 152 (shown in FIG. 3) terminated to the cables 148. The cabled receptacle connector 112 includes a receptacle housing 160 that receives the cable assembly 150. The cabled receptacle connector 112 includes a latch 170 coupled to the receptacle housing 160.

Figure 3:
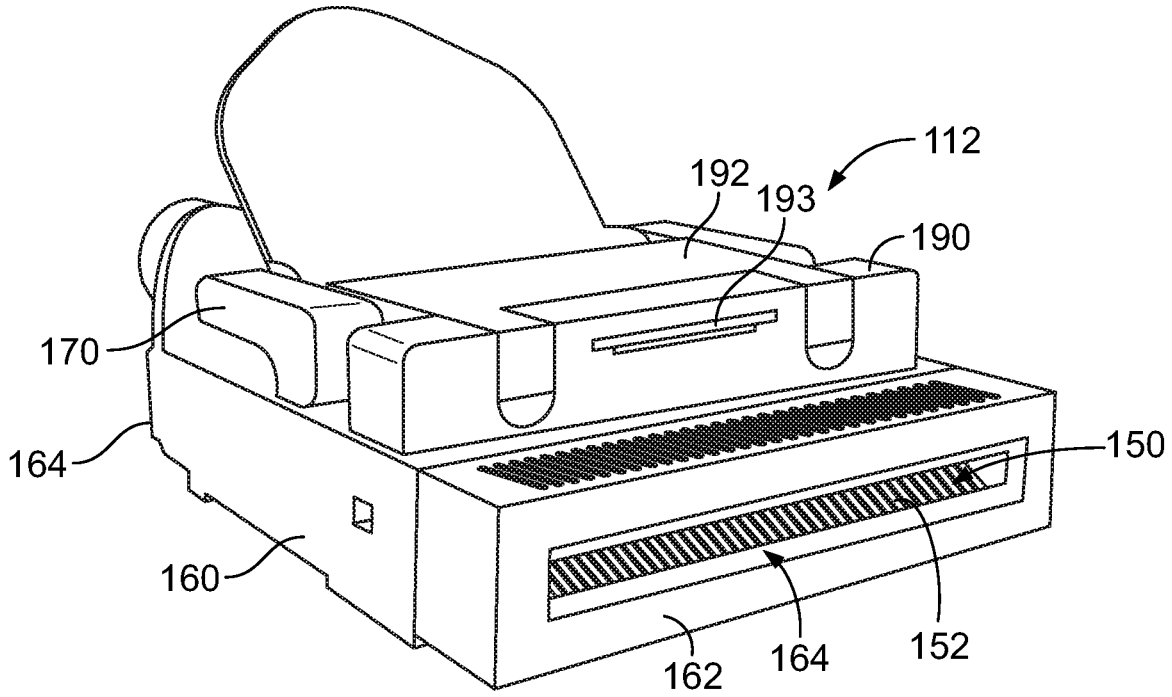
FIG. 3 is a front perspective view of a cabled receptacle connector in accordance with an exemplary embodiment.

FIG. 3 is a front perspective view of the cabled receptacle connector 112 in accordance with an exemplary embodiment. The cabled receptacle connector 112 includes the receptacle housing 160 having the latch 170 coupled thereto. The receptacle housing 160 extends between a mating end 162 and a cable end 164. Optionally, the receptacle housing 160 may be a multi-piece housing, such as including a front housing at the mating end 162 coupled to a main housing body. In alternative embodiments, the receptacle housing 160 may be a single-piece housing. The receptacle housing 160 has a cavity 165 extending between the mating end 162 and the cable end 164. The cavity 165 receives the cable assembly 150. The housing 160 holds the contacts 152 of the cable assembly 150 in a mating slot 166 at a front of the housing 160. The mating slot 166 forms part of the cavity 165, such as the front end of the cavity 165. The mating slot 166 is configured to receive part of the pluggable module 106 (FIG. 1), such as the module circuit board 128 (FIG. 1). The contacts 152 are configured to be positioned in the mating slot 166 for interfacing with the module circuit board 128.

Figure 4:
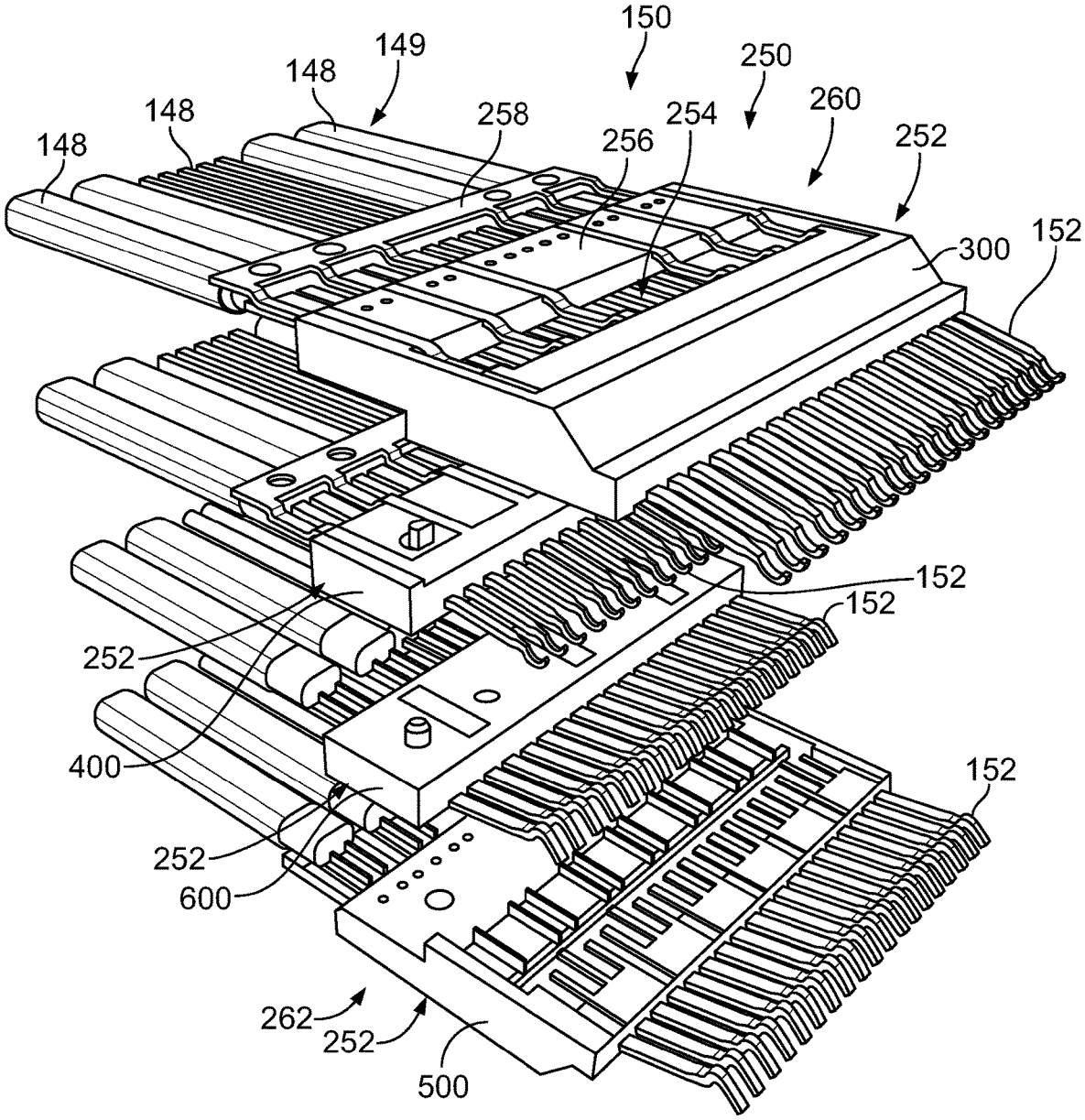
FIG. 4 is a front perspective view of a cable assembly of the cabled receptacle connector in accordance with an exemplary embodiment.

FIG. 4 is a front perspective view of the cable assembly 150 in accordance with an exemplary embodiment. The cable assembly 150 includes a wafer stack 250 having a plurality of wafers 252 arranged in a stacked configuration. The wafer stack 250 is provided at an end of the cable bundle 149. The wafers 252 are terminated to ends of the cables 148. The wafers 252 may be similar to each other. For example, each of the wafers 252 may include a wafer lead frame 254 formed from a plurality of the contacts 152. Each of the wafers 252 may include a dielectric frame 256 holding the wafer lead frame 254. Each of the wafers 252 may include a ground bus frame 258 coupled to the dielectric frame 256 and electrically connected to corresponding contacts 152. The ground bus frame 258 may be electrically connected to corresponding cables 148.

In an exemplary embodiment, the wafer stack 250 includes an upper wafer assembly 260 and a lower wafer assembly 262 coupled to the upper wafer assembly 260. The upper wafer assembly 260 has corresponding cables 148 extending therefrom and the lower wafer assembly 262 have corresponding cables 148 extending therefrom. In the illustrated embodiment, the upper wafer assembly 260 has a plurality of wafers 252 and the lower wafer assembly 262 has a plurality of wafers 252. For example, the upper wafer assembly 260 includes an upper outboard wafer 300 and an upper inboard wafer 400 and the lower wafer assembly 262 includes a lower outboard wafer 500 and a lower inboard wafer 600. In alternative embodiments, the upper wafer assembly 260 may include a single wafer 252 and the lower wafer assembly 262 may include a single wafer 252.

In an exemplary embodiment, the lower outboard wafer 500 is similar or identical to the upper outboard wafer 300 and inverted 180° relative thereto. In an exemplary embodiment, the lower inboard wafer 600 is similar or identical to the upper inboard wafer 400 and inverted 180° relative thereto.

Figure 5:
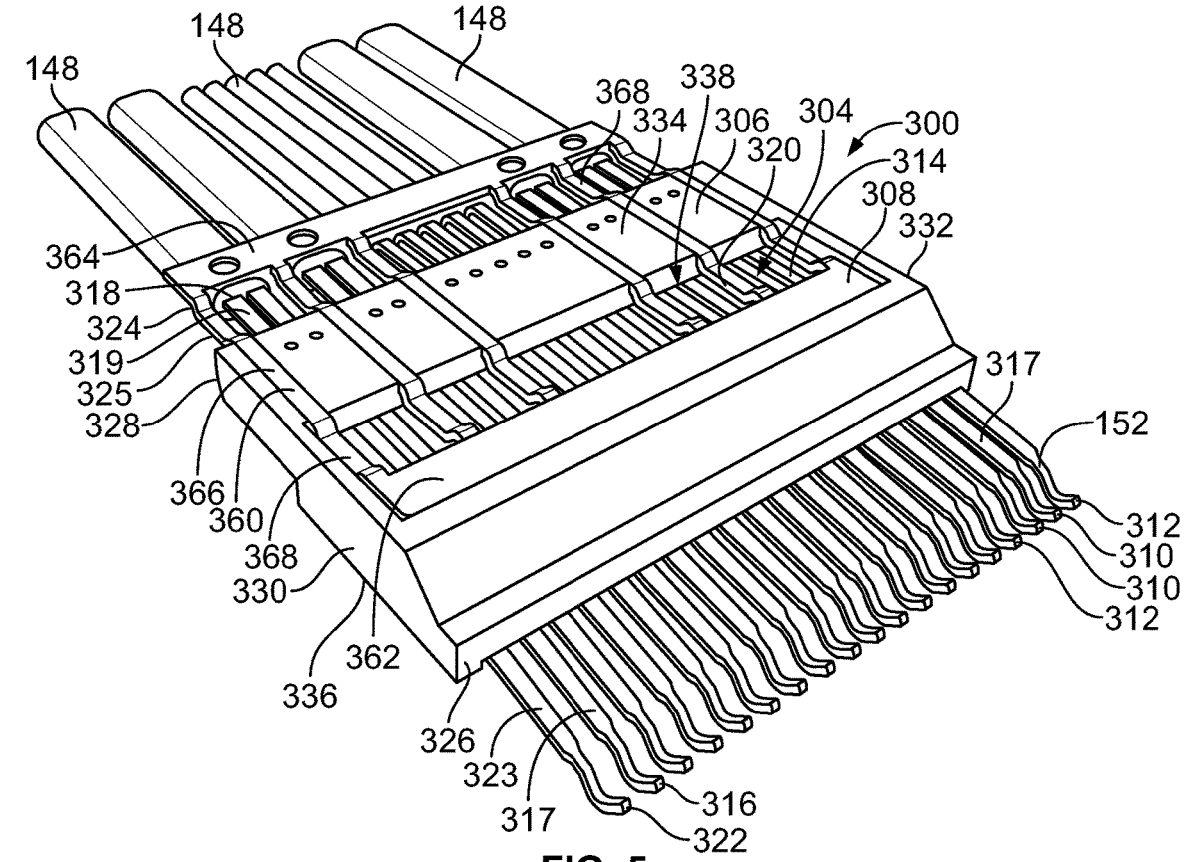
FIG. 5 is a top view of a wafer of the cable assembly in accordance with an exemplary embodiment.
Figure 6:
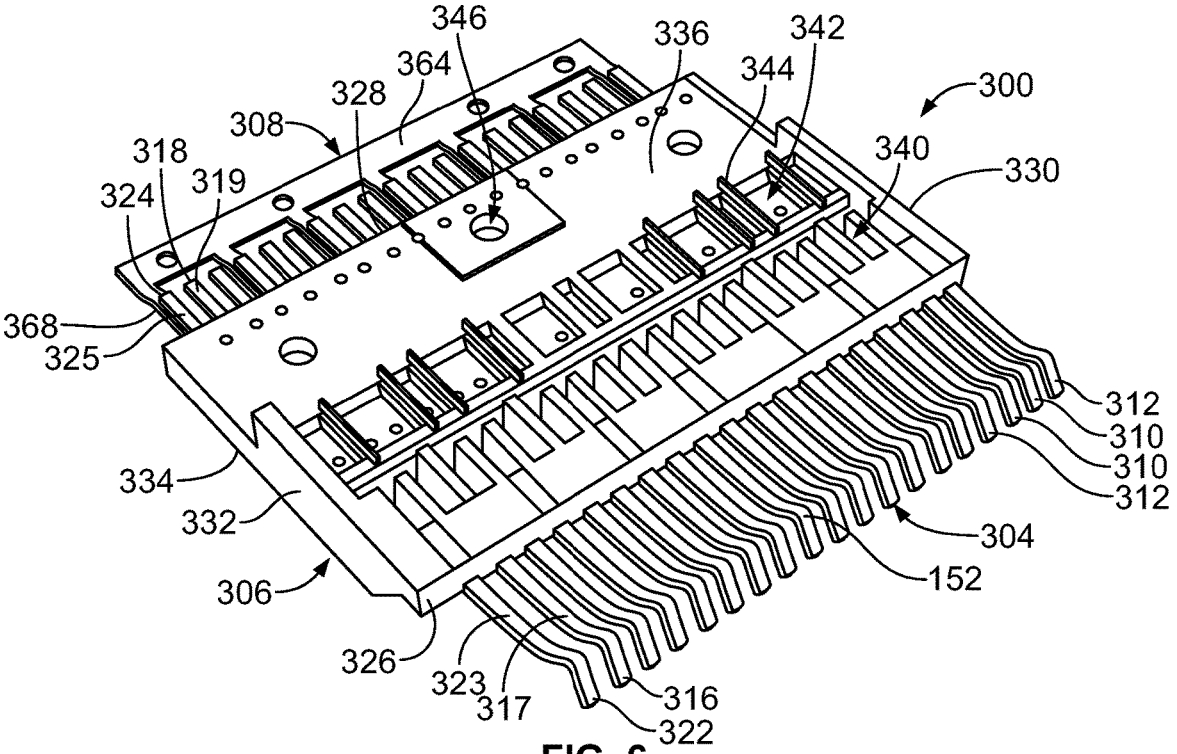
FIG. 6 is a bottom perspective view of a wafer of the cable assembly in accordance with an exemplary embodiment.

FIG. 5 is a top view of the upper outboard wafer 300 in accordance with an exemplary embodiment. FIG. 6 is a bottom perspective view of the upper outboard wafer 300 in accordance with an exemplary embodiment. The upper outboard wafer 300 includes a wafer lead frame 304 including a plurality of the contacts 152. The upper outboard wafer 300 includes a dielectric frame 306 holding the wafer lead frame 304. The upper outboard wafer 300 includes a ground bus frame 308 coupled to the dielectric frame 306.

The wafer lead frame 304 may be a stamped and formed lead frame forming the contacts 152. In an exemplary embodiment, the wafer lead frame 304 includes a plurality of signal contacts 310 and a plurality of ground contacts 312 interspersed with the signal contacts 310. The ground contacts 312 provide electrical shielding between various signal contacts 310. For example, the signal contacts 310 may be arranged in pairs with the ground contacts 312 arranged between pairs of the signal contacts 310. However, the signal contacts 310 and the ground contacts 312 may have other arrangements in alternative embodiments.

The signal contacts 310 have contact bodies 314 extending between mating ends 316 and terminating ends 318. The mating ends 316 are provided at the fronts of the signal contacts 310 for mating with the pluggable module 106 (shown in FIG. 1). In an exemplary embodiment, the mating ends 316 include deflectable spring beams 317; however, other types of mating ends may be provided in alternative embodiments. The terminating ends 318 are provided at the rears of the signal contacts 310 for terminating to the cables 148 (FIG. 5). In an exemplary embodiment, the terminating ends 318 include weld pads 319 configured to be laser welded to conductors of the cables 148; however, other types of terminating ends may be provided in alternative embodiments.

The ground contacts 312 have contact bodies 320 extending between mating ends 322 and terminating ends 324. The mating ends 322 are provided at the fronts of the ground contacts 312 for mating with the pluggable module 106 (shown in FIG. 1). In an exemplary embodiment, the mating ends 322 include deflectable spring beams 323; however, other types of mating ends may be provided in alternative embodiments. The terminating ends 324 are provided at the rears of the ground contacts 312 for terminating to the cables 148 (FIG. 5). In an exemplary embodiment, the terminating ends 324 include weld pads 325 configured to be laser welded to conductors of the cables 148; however, other types of terminating ends may be provided in alternative embodiments.

The dielectric frame 306 extends between a front 326 and a rear 328. The dielectric frame 306 includes a first side 330 and a second side 332 opposite the first side 330. The dielectric frame 306 includes a first end 334 and a second end 336 opposite the first end 334. In the illustrated embodiment, the first end 334 is an outer end and the second end 336 is an inner end. The upper outboard wafer 300 is oriented such that the first end 334 is a top end. The dielectric frame 306 holds the wafer lead frame 304. The dielectric frame 306 may be manufactured from a plastic material. In an exemplary embodiment, the dielectric frame 306 is overmolded over the wafer lead frame 304. The dielectric frame 306 encases or encloses portions of the signal contacts 310 and portions of the ground contacts 312. In an exemplary embodiment, the mating ends 316, 322 extend forward of the front 326 for mating with the pluggable module 106 and the terminating ends 318, 324 extend rearward from the rear 328 for termination with the cables 148.

In an exemplary embodiment, the dielectric frame 306 includes a window 338 that exposes portions of the contact bodies 314. The ground bus frame 308 extends into the window 338 to electrically connect to the ground contacts 312 within the window 338. In the illustrated embodiment, the window 338 is provided at the first end 334. In an exemplary embodiment, the dielectric frame 306 includes cavities 340 at the second end 336. The cavities 340 are configured to receive contacts 152 of the upper inboard wafer 400 (shown in FIG. 4). The cavities 340 provide a space for mating ends of the contacts 152 of the upper inboard wafer 400 to move during mating with the pluggable module 106. In an exemplary embodiment, the dielectric frame 306 includes voids 342 at the second end 336. The voids 342 provide a space for air to provide impedance control for the signal contacts 310 and/or the ground contacts 312 and/or for the contacts 152 of the upper inboard wafer 400.

In an exemplary embodiment, the dielectric frame 306 includes separating walls 344 extending from the second end 336 configured to extend between corresponding contacts 152 of the upper inboard wafer 400. The separating walls 344 may be located between corresponding voids 342. The separating walls 344 may extend parallel to the first and second sides 330, 332. The alignment walls 344 may have other orientations in alternative embodiments.

In an exemplary embodiment, the dielectric frame 306 includes alignment openings 346 in the second end 336 configured to receive alignment posts of the upper inboard wafer 400 to locate the upper outboard wafer 300 relative to the upper inboard wafer 400. In the illustrated embodiment, the alignment openings 346 are located proximate to the rear 328.

The ground bus frame 308 is coupled to the first end 334 of the dielectric frame 306 and is electrically coupled to the wafer lead frame 304. For example, the ground bus frame 308 is electrically connected to each of the ground contacts 312. The ground bus frame 308 electrically commons each of the ground contacts 312. The ground bus frame 308 is manufactured from a conductive material, such as a metal material. In an exemplary embodiment, the ground bus frame 308 is a stamped and formed structure.

The ground bus frame 308 includes ground beams 360 connected by a front tie beam 362 and a rear tie beam 364. The tie beams 362, 364 mechanically and electrically connect the ground beams 360 together. In the illustrated embodiment, the front tie beam 362 is coupled to the dielectric frame 306. In the illustrated embodiment, the rear tie beam 364 is configured to be coupled to the cables 148. The rear tie beam 364 may be mechanically and/or electrically connected to the cables 148, such as to a cable shield of the cables 148. The ground beams 360 are configured to be coupled to corresponding ground contacts 312. In an exemplary embodiment, the ground beams 360 are configured to be coupled to each ground contact 312 at multiple points of contact along the length of the ground contacts 312. Having multiple points of contact between the ground beams 360 and the ground contacts 312 increases the ground resonance frequency of the ground bus frame 308.

The ground beams 360 include mounting arms 366 and mating pads 368 extending from the mounting arms 366. In an exemplary embodiment, the ground beams 360 are non-planar having the mating pads 368 extending downward from the mounting arms 366. The mounting arms 366 are coupled to the dielectric frame 306. For example, the mounting arms 366 extend over the top of the first end 334. The mating pads 368 are configured to be coupled to the ground contacts 312. For example, the mating pads 368 extend from the mounting arms 366 into the window 338 to interface with the contact bodies 320 of corresponding ground contacts 312. In an exemplary embodiment, the mating pads 368 are laser welded to the contact bodies 320 of the ground contacts 312. The mating pads 368 may extend rearward of the dielectric frame 306 to interface with the terminating ends 324 of corresponding ground contacts 312. In an exemplary embodiment, the mating pads 368 are laser welded to the terminating ends 324 of the ground contacts 312.

In an exemplary embodiment, the ground bus frame 308 is coupled to the dielectric frame 306 and the wafer lead frame 304 after the cables 148 are terminated to the wafer lead frame 304. For example, conductors of the cables 148 are welded or soldered to the signal contacts 310. The rear tie beam 364 may be welded to cable shields of the cables 148.

Figure 7:
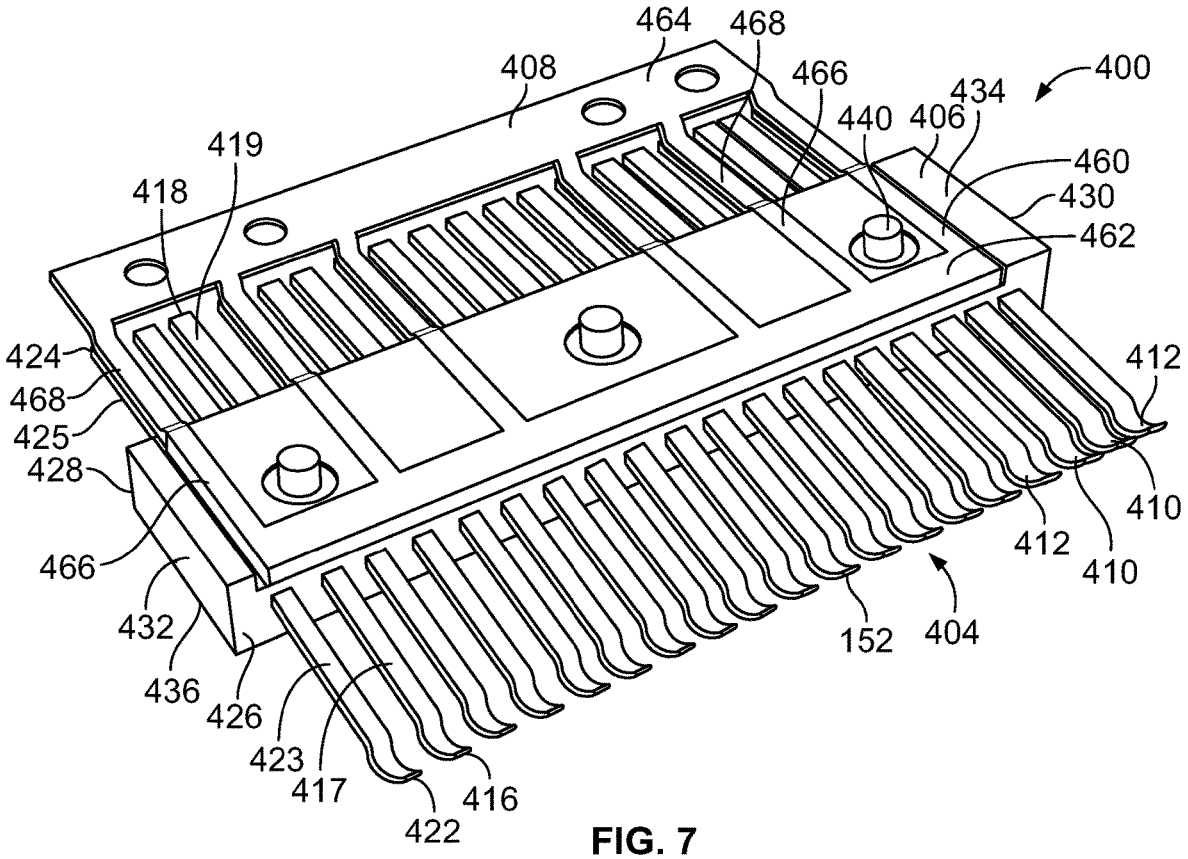
FIG. 7 is a top view of a wafer of the cable assembly in accordance with an exemplary embodiment.
Figure 8:
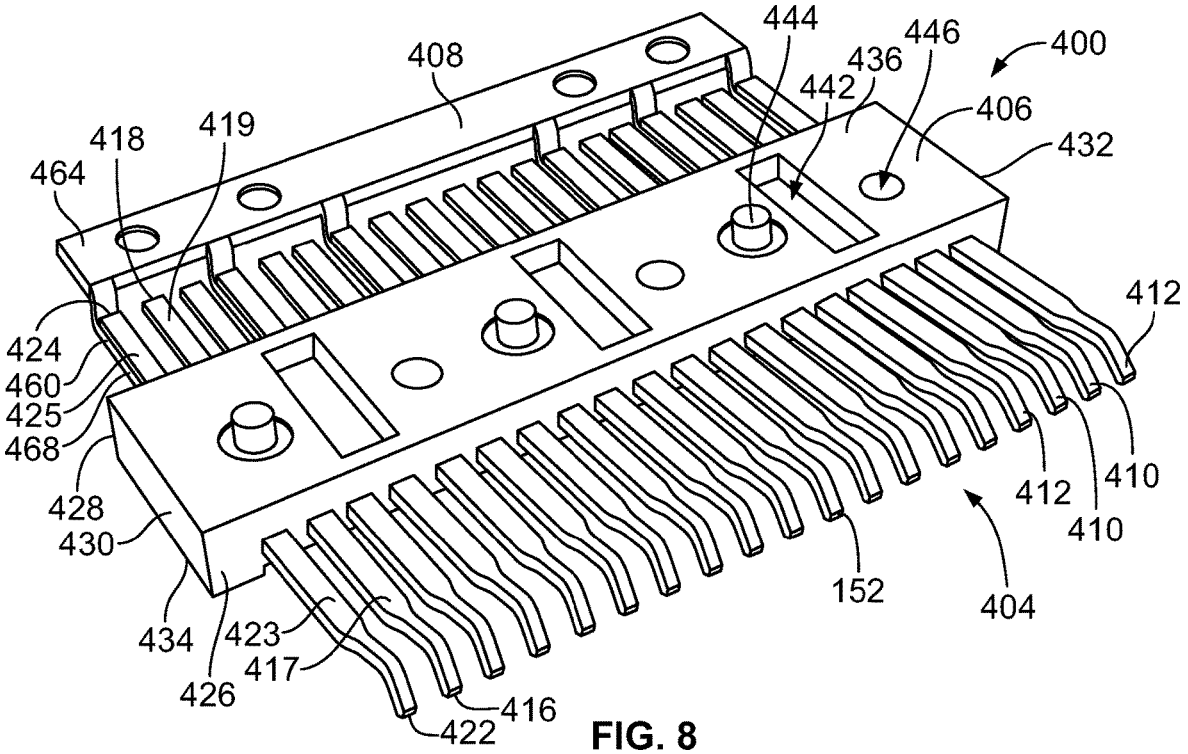
FIG. 8 is a bottom perspective view of a wafer of the cable assembly in accordance with an exemplary embodiment.

FIG. 7 is a top view of the upper inboard wafer 400 in accordance with an exemplary embodiment. FIG. 8 is a bottom perspective view of the upper inboard wafer 400 in accordance with an exemplary embodiment. The upper inboard wafer 400 includes a wafer lead frame 404 including a plurality of the contacts 152. The upper inboard wafer 400 includes a dielectric frame 406 holding the wafer lead frame 404. The upper inboard wafer 400 includes a ground bus frame 408 coupled to the dielectric frame 406.

The wafer lead frame 404 may be a stamped and formed lead frame forming the contacts 152. In an exemplary embodiment, the wafer lead frame 404 includes a plurality of signal contacts 410 and a plurality of ground contacts 412 interspersed with the signal contacts 410. The ground contacts 412 provide electrical shielding between various signal contacts 410. For example, the signal contacts 410 may be arranged in pairs with the ground contacts 412 arranged between pairs of the signal contacts 410. However, the signal contacts 410 and the ground contacts 412 may have other arrangements in alternative embodiments.

The signal contacts 410 have contact bodies (not shown) extending between mating ends 416 and terminating ends 418. The mating ends 416 are provided at the fronts of the signal contacts 410 for mating with the pluggable module 106 (shown in FIG. 1). In an exemplary embodiment, the mating ends 416 include deflectable spring beams 417; however, other types of mating ends may be provided in alternative embodiments. The terminating ends 418 are provided at the rears of the signal contacts 410 for terminating to the cables 148 (FIG. 4). In an exemplary embodiment, the terminating ends 418 include weld pads 419 configured to be laser welded to conductors of the cables 148; however, other types of terminating ends may be provided in alternative embodiments.

The ground contacts 412 have contact bodies (not shown) extending between mating ends 422 and terminating ends 424. The mating ends 422 are provided at the fronts of the ground contacts 412 for mating with the pluggable module 106 (shown in FIG. 1). In an exemplary embodiment, the mating ends 422 include deflectable spring beams 423; however, other types of mating ends may be provided in alternative embodiments. The terminating ends 424 are provided at the rears of the ground contacts 412 for terminating to the cables 148 (FIG. 4). In an exemplary embodiment, the terminating ends 424 include weld pads 425 configured to be laser welded to conductors of the cables 148; however, other types of terminating ends may be provided in alternative embodiments.

The dielectric frame 406 extends between a front 426 and a rear 428. The dielectric frame 406 includes a first side 430 and a second side 432 opposite the first side 430. The dielectric frame 406 includes a first end 434 and a second end 436 opposite the first end 434. The upper inboard wafer 400 is oriented such that the first end 434 is a top end. The dielectric frame 406 holds the wafer lead frame 404. The dielectric frame 406 may be manufactured from a plastic material. In an exemplary embodiment, the dielectric frame 406 is overmolded over the wafer lead frame 404. The dielectric frame 406 encases or encloses portions of the signal contacts 410 and portions of the ground contacts 412. In an exemplary embodiment, the mating ends 416, 422 extend forward of the front 426 for mating with the pluggable module 106 and the terminating ends 418, 424 extend rearward from the rear 428 for termination with the cables 148.

In an exemplary embodiment, the dielectric frame 406 includes alignment posts 440 extending from the first end 434 configured to be received in the alignment openings 346 (shown in FIG. 6) of the upper outboard wafer 300 to locate the upper inboard wafer 400 relative to the upper outboard wafer 300. Optionally, the posts 440 may include crush ribs. Other types of locating features may be used in alternative embodiments.

In an exemplary embodiment, the dielectric frame 406 includes voids 442 at the second end 436. The voids 442 provide a space for air to provide impedance control for the signal contacts 410 and/or the ground contacts 412.

In an exemplary embodiment, the dielectric frame 406 includes alignment posts 444 extending from the second end 436 configured to be received in a lower inboard wafer 600 (FIG. 4) to locate the upper inboard wafer 400 relative to the lower inboard wafer 600. Optionally, the posts 444 may include crush ribs. Other types of locating features may be used in alternative embodiments.

In an exemplary embodiment, the dielectric frame 406 includes alignment openings 446 in the second end 436 configured to receive alignment posts of the lower inboard wafer 600 to locate the upper inboard wafer 400 relative to the lower inboard wafer 600. In the illustrated embodiment, the alignment openings 446 are located proximate to the rear 428.

The ground bus frame 408 is coupled to the first end 434 of the dielectric frame 406 and is electrically coupled to the wafer lead frame 404. For example, the ground bus frame 408 is electrically connected to each of the ground contacts 412. The ground bus frame 408 electrically commons each of the ground contacts 412. The ground bus frame 408 is manufactured from a conductive material, such as a metal material. In an exemplary embodiment, the ground bus frame 408 is a stamped and formed structure.

The ground bus frame 408 includes ground beams 460 connected by a front tie beam 462 and a rear tie beam 464. The tie beams 462, 464 mechanically and electrically connect the ground beams 460 together. In the illustrated embodiment, the front tie beam 462 is coupled to the dielectric frame 406. In the illustrated embodiment, the rear tie beam 464 is configured to be coupled to the cables 148. The rear tie beam 464 may be mechanically and/or electrically connected to the cables 148, such as to a cable shield of the cables 148. The ground beams 460 are configured to be coupled to corresponding ground contacts 412.

The ground beams 460 include mounting arms 466 and mating pads 468 extending from the mounting arms 466. In an exemplary embodiment, the ground beams 460 are non-planar having the mating pads 468 extending downward from the mounting arms 466. The mounting arms 466 are coupled to the dielectric frame 406. The mating pads 468 are configured to be coupled to the ground contacts 412. The mating pads 468 extend rearward of the dielectric frame 406 to interface with the terminating ends 424 of corresponding ground contacts 412. In an exemplary embodiment, the mating pads 468 are laser welded to the terminating ends 424 of the ground contacts 412.

In an exemplary embodiment, the ground bus frame 408 is coupled to the dielectric frame 406 and the wafer lead frame 404 after the cables 148 are terminated to the wafer lead frame 404. For example, conductors of the cables 148 are welded or soldered to the signal contacts 410. The rear tie beam 464 may be welded to cable shields of the cables 148.

Figure 9:
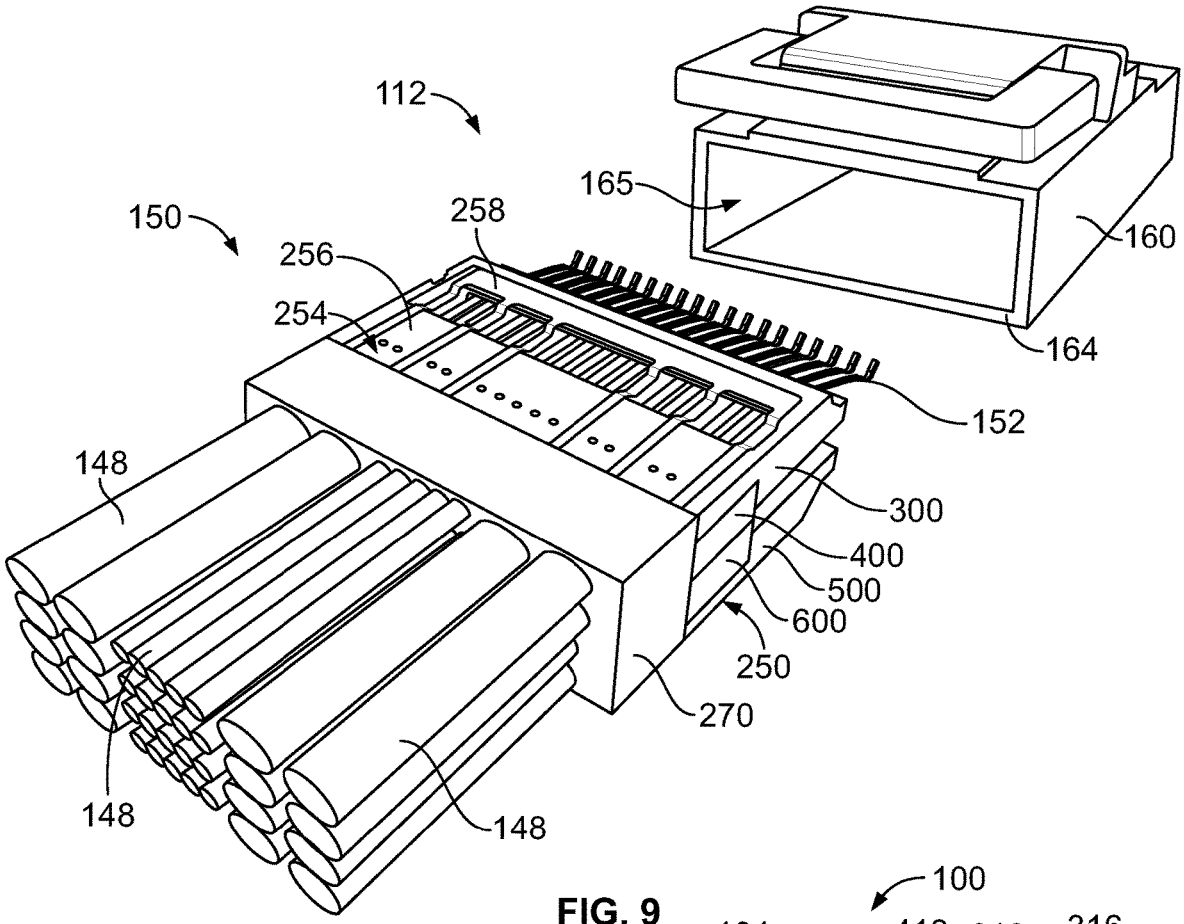
FIG. 9 is a rear perspective view of the cabled receptacle connector in accordance with an exemplary embodiment.

FIG. 9 is a rear perspective view of the cabled receptacle connector 112 in accordance with an exemplary embodiment. FIG. 9 illustrates the cable assembly 150 poised for loading into the cavity 165 of the receptacle housing 160. In the illustrated embodiment, the cable assembly 150 is configured to be loaded into the cable end 164 at the rear of the receptacle housing 160.

During assembly, the wafers 252 of the wafer stack 250 are assembled. For example, the wafer stack 250 includes the upper outboard wafer 300, the upper inboard wafer 400, the lower inboard wafer 600, and the lower outboard wafer 500. The inboard wafers 400, 500 are arranged between the outboard wafers 300, 600. The dielectric frames 256 are stacked together, such as using the locating features, such as the locating posts.

In an exemplary embodiment, the cable assembly 150 includes a dielectric holder 270 coupled to the wafers 252. The dielectric holder 270 is coupled to the cables 148. The dielectric holder 270 provide strain relief for the cables 148. The dielectric holder 270 may be an overmold body. Optionally, the dielectric holder 270 may be formed in place on each of the wafers 252 of the wafer stack 250 to secure each of the wafers 252 together. The dielectric holder 270 may cover portions of the ground bus frames 258 of the wafers 252. The dielectric holder 270 may cover the weld interfaces between the ground bus frames 258 and the cables 148 and/or the contacts 152.

Figure 10:
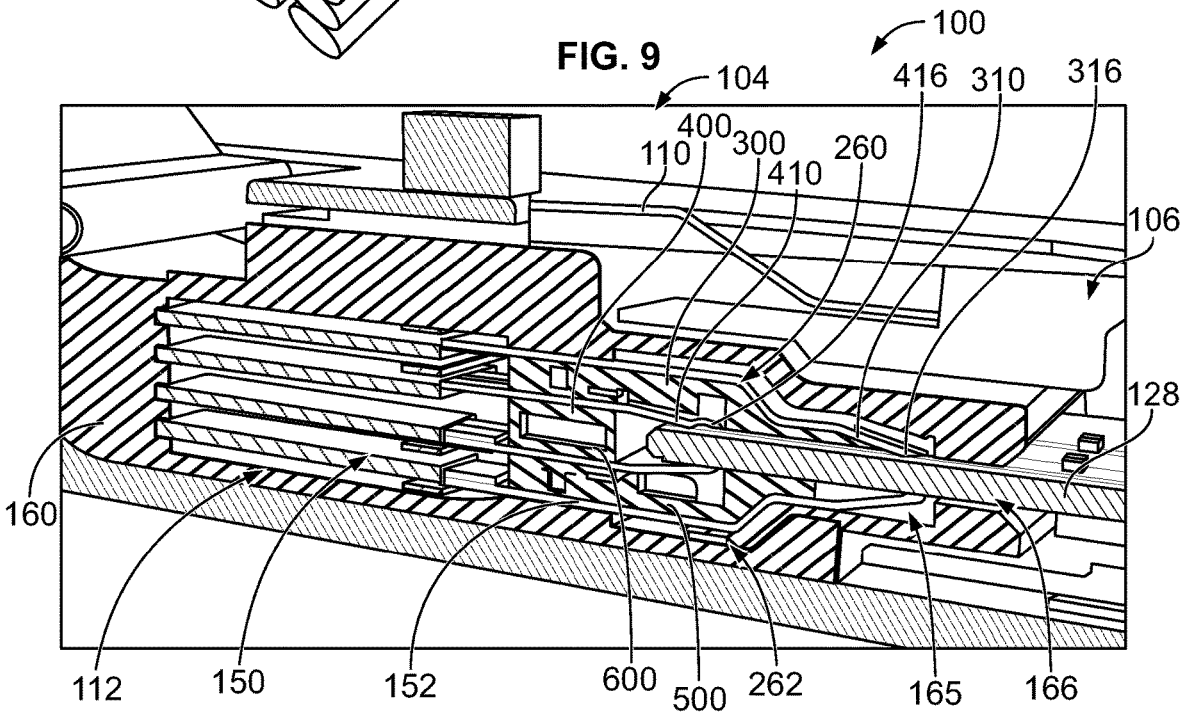
FIG. 10 is a cross-sectional view of a portion of the communication system in accordance with an exemplary embodiment.

FIG. 10 is a cross-sectional view of a portion of the communication system 100 showing a portion of the pluggable module 106 received in the receptacle assembly 104. FIG. 10 illustrates the cabled receptacle connector 112 in the receptacle cage 110 mated with the pluggable module 106. The cable assembly 150 is received in the cavity 165 of the receptacle housing 160. The contacts 152 are arranged in the mating slot 166 for mating with the module circuit board 128. In an exemplary embodiment, the contacts 152 of the upper wafer assembly 260 interface with the top side of the module circuit board 128 and the contacts 152 of the lower wafer assembly 262 interface with the lower surface of the module circuit board 128.

In an exemplary embodiment, the contacts 152 are arranged in multiple rows along the upper surface and the lower surface of the module circuit board 128. For example, the upper outboard wafer 300 extends forward of the upper inboard wafer 400 and the lower outboard wafer 500 extend forward of the lower inboard wafer 600. The mating ends 316 of the signal contacts 310 of the upper outboard wafer 300 are positioned forward of the mating ends 416 of the signal contacts 410 of the upper inboard wafer 400. A similar arrangement occurs with the lower outboard wafer 500 and the lower inboard wafer 600. The density of the mating interface between the module circuit board 128 and the cable assembly 150 is increased by arranging the signal contacts in multiple rows on both sides of the mating slot 166.

It is understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A cabled receptacle connector for a receptacle assembly comprising:

a receptacle housing having a cavity extending between a front and a rear of the receptacle housing, the receptacle housing having a mating slot at the front configured to receive a pluggable module removably received in a receptacle cage of the receptacle assembly; and a cable assembly received in the cavity, the cable assembly comprising wafers arranged in a wafer stack, each wafer provided at an end of a cable bundle, each wafer having a dielectric frame holding a wafer lead frame, the wafer lead frame having signal contacts and ground contacts interspersed with the signal contacts, the signal contacts having terminating ends terminated to corresponding cables of the cable bundle, the ground contacts having terminating ends terminated to corresponding cables of the cable bundle, the signal contacts having mating ends received in the mating slot for mating with the pluggable module, the ground contacts having mating ends received in the mating slot for mating with the pluggable module, each wafer having a ground bus frame electrically coupled to each of the ground contacts of the corresponding wafer to electrically common each of the ground contacts, the ground bus frame including ground beams extending along a length of the ground contacts, the ground beams having mounting arms and mating pads extending from the mounting arms, the mounting arms being coupled to the dielectric frame, the mating pads extending along the ground contacts for coupling to corresponding ground contacts;

wherein the mating ends of the signal contacts and the ground contacts are arranged in multiple rows for interfacing with the pluggable module.

2. The cabled receptacle connector of claim 1, wherein the ground bus frame includes a tie beam mechanically and electrically connecting the ground beams together.

3. The cabled receptacle connector of claim 2, wherein the tie beam is a front tie beam, the ground bus frame including a rear tie beam connecting the ground beams.

4. The cabled receptacle connector of claim 1, wherein each ground beam is coupled to the corresponding ground contact at a plurality of spaced apart locations.

5. The cabled receptacle connector of claim 1, wherein the dielectric frame includes a window open at an end of the dielectric frame, the window exposing the ground contacts, the ground bus frame extending into the opening to engage the ground contacts in the window.

6. The cabled receptacle connector of claim 1, wherein the ground bus frame is laser welded to the ground contacts.

7. The cabled receptacle connector of claim 1, wherein the ground bus frame includes a tie bar mechanically and electrically coupled to cable shields of each of the cables.

8. The cabled receptacle connector of claim 1, wherein the wafers in the wafer stack comprise:

a first wafer having a first dielectric frame holding a first wafer lead frame, the first wafer lead frame having first signal contacts and first ground contacts interspersed with the first signal contacts, the first signal contacts having terminating ends terminated to corresponding cables of the cable bundle, the first ground contacts having terminating ends terminated to corresponding cables of the cable bundle, the first signal contacts having mating ends received in the mating slot for mating with the pluggable module, the first ground contacts having mating ends received in the mating slot for mating with the pluggable module, the first wafer having a first ground bus frame electrically coupled to each of the ground contacts to electrically common each of the ground contacts; and a second wafer having a second dielectric frame holding a second wafer lead frame, the second wafer lead frame having second signal contacts and second ground contacts interspersed with the second signal contacts, the second signal contacts having terminating ends terminated to corresponding cables of the cable bundle, the second ground contacts having terminating ends terminated to corresponding cables of the cable bundle, the second signal contacts having mating ends received in the mating slot for mating with the pluggable module, the second ground contacts having mating ends received in the mating slot for mating with the pluggable module, the second wafer having a second ground bus frame electrically coupled to each of the second ground contacts to electrically common each of the second ground contacts.

9. The cabled receptacle connector of claim 1, wherein the wafers include an upper outboard wafer and an upper inboard wafer arranged in an upper wafer assembly, and wherein the wafers include a lower outboard wafer and a lower inboard wafer arranged in a lower wafer assembly, the lower and upper inboard wafers being stacked between the lower and upper outboard wafers.

10. The cabled receptacle connector of claim 9, wherein the first wafer extends forward of the second wafer and the mating ends of the first wafer are in a first row positioned forward of a second row of the mating ends of the second wafer.

11. The cabled receptacle connector of claim 1, wherein the dielectric frame includes an overmold body overmolded around the wafer lead frame.

12. A cabled receptacle connector for a receptacle assembly comprising:

a receptacle housing having a cavity extending between a front and a rear of the receptacle housing, the receptacle housing having a mating slot at the front configured to receive a pluggable module removably received in a receptacle cage of the receptacle assembly; and a cable assembly received in the cavity, the cable assembly including a wafer stack provided at an end of a cable bundle, the wafer stack having a plurality of wafers arranged in a stacked configuration, the plurality of wafers includes an upper outboard wafer and an upper inboard wafer arranged in an upper wafer assembly, the plurality of wafers includes a lower outboard wafer and a lower inboard wafer arranged in a lower wafer assembly, the lower and upper inboard wafers being stacked between the lower and upper outboard wafers, each wafer having a dielectric frame holding a wafer lead frame, the wafer lead frame having signal contacts and ground contacts interspersed with the signal contacts, the signal contacts having terminating ends terminated to corresponding cables of the cable bundle, the ground contacts having terminating ends terminated to corresponding cables of the cable bundle, the signal contacts having mating ends received in the mating slot for mating with the pluggable module, the ground contacts having mating ends received in the mating slot for mating with the pluggable module, each wafer having a ground bus frame electrically coupled to each of the corresponding ground contacts to electrically common each of the ground contacts, the cable assembly having a dielectric holder coupled to the dielectric frames of the plurality of wafers to hold the dielectric frames relative to each other, the dielectric holder encasing ends of the cables of the cable bundle, the dielectric holder encasing at least a portion of each ground bus frame.

13. The cabled receptacle connector of claim 12, wherein the upper outboard wafer extends forward of the upper inboard wafer and the mating ends of the upper outboard wafer are positioned forward of the mating ends of the upper inboard wafer, and wherein the lower outboard wafer extends forward of the lower inboard wafer and the mating ends of the lower outboard wafer are positioned forward of the mating ends of the lower inboard wafer.

14. The cabled receptacle connector of claim 12, wherein the upper outboard wafer includes cavities receiving the mating ends of the upper inboard wafer, and wherein the lower outboard wafer includes cavities receiving the mating ends of the lower inboard wafer.

15. The cabled receptacle connector of claim 12, wherein the ground bus frame includes ground beams connected by a tie beam, the ground beams being coupled to corresponding ground contacts, the tie beam mechanically and electrically connecting the ground beams together.

16. The cabled receptacle connector of claim 12, wherein the ground bus frame includes a tie bar mechanically and electrically coupled to cable shields of corresponding cables.

17. A receptacle assembly comprising:

a receptacle cage having a plurality of walls defining a module channel extending between a front and a rear of the receptacle cage, the plurality of walls including a top wall, a first side wall extending from the top wall to a bottom of the receptacle cage and a second side wall extending from the top wall to the bottom, wherein the module channel is open at the front to receive a pluggable module therein, the module channel being open at the rear; and a cabled receptacle connector received in the module channel at the rear of the receptacle cage, the cabled receptacle connector comprising:

a receptacle housing having a cavity extending between a front and a rear of the receptacle housing, the receptacle housing having a mating slot at the front configured to receive the pluggable module; and a cable assembly received in the cavity, the cable assembly comprising:

a first wafer provided at an end of a cable bundle, the first wafer having a first dielectric frame holding a first wafer lead frame, the first wafer lead frame having first signal contacts and first ground contacts interspersed with the first signal contacts, the first signal contacts having terminating ends terminated to corresponding cables of the cable bundle, the first ground contacts having terminating ends terminated to corresponding cables of the cable bundle, the first signal contacts having mating ends received in the mating slot for mating with the pluggable module, the first ground contacts having mating ends received in the mating slot for mating with the pluggable module, the first wafer having a first ground bus frame having first ground beams extending along a length the corresponding first ground contacts, the first ground beams being electrically coupled to each of the first ground contacts to electrically common each of the first ground contacts; and a second wafer having a second dielectric frame holding a second wafer lead frame, the second wafer lead frame having second signal contacts and second ground contacts interspersed with the second signal contacts, the second signal contacts having terminating ends terminated to corresponding cables of the cable bundle, the second ground contacts having terminating ends terminated to corresponding cables of the cable bundle, the second signal contacts having mating ends received in the mating slot for mating with the pluggable module, the second ground contacts having mating ends received in the mating slot for mating with the pluggable module, the second wafer having a second ground bus frame having second ground beams extending along a length of the corresponding second ground contacts, the second ground beams being electrically coupled to each of the second ground contacts to electrically common each of the second ground contacts;

wherein the first wafer extends forward of the second wafer and the mating ends of the first wafer are in a first row positioned forward of a second row of the mating ends of the second wafer.

18. The receptacle assembly of claim 17, wherein the first ground bus frame includes first ground beams connected by a first tie beam, the first ground beams being coupled to corresponding ground contacts, the first tie beam mechanically and electrically connecting the first ground beams together, and wherein the second ground bus frame includes second ground beams connected by a second tie beam, the second ground beams being coupled to corresponding ground contacts, the second tie beam mechanically and electrically connecting the second ground beams together.

19. The receptacle assembly of claim 17, wherein the first ground bus includes first ground beams having first mounting arms and first mating pads extending from the first mounting arms, the first mounting arms being coupled to the first dielectric frame, the first mating pads being coupled to corresponding first ground contacts, and wherein the second ground bus includes second ground beams having second mounting arms and second mating pads extending from the second mounting arms, the second mounting arms being coupled to the second dielectric frame, the second mating pads being coupled to corresponding second ground contacts.

20. The receptacle assembly of claim 17, wherein the first wafer is an upper outboard wafer and the second wafer is an upper inboard wafer arranged in an upper wafer assembly, the cable assembly further comprising a third wafer being a lower outboard wafer and a fourth wafer being a lower inboard wafer arranged in a lower wafer assembly, the lower and upper inboard wafers being stacked between the lower and upper outboard wafers.

21. The receptacle assembly of claim 17, wherein the cable assembly includes a dielectric holder coupled to the first wafer dielectric frame and the second wafer dielectric frame to hold the first and second wafer dielectric frames relative to each other, the dielectric holder encasing ends of the cables, the dielectric holder encasing at least a portion of the first ground bus frame and at least a portion of the second ground bus frame.

22. The cabled receptacle connector of claim 1, wherein the cable assembly includes a dielectric holder coupled to each of the dielectric frames to hold the dielectric frames relative to each other, the dielectric holder encasing ends of the cables of the cable bundle, the dielectric holder encasing at least a portion of each ground bus frame.

23. The cabled receptacle connector of claim 12, wherein the ground bus frame includes ground beams extending along a length of the ground contacts.

* * * * *